US008803932B2

(12) United States Patent
Matsutani

(10) Patent No.: US 8,803,932 B2
(45) Date of Patent: Aug. 12, 2014

(54) PRINTER

(71) Applicant: Megumi Matsutani, Okazaki (JP)

(72) Inventor: Megumi Matsutani, Okazaki (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/626,005

(22) Filed: Sep. 25, 2012

(65) Prior Publication Data

US 2013/0033555 A1 Feb. 7, 2013

Related U.S. Application Data

(63) Continuation-in-part of application No. PCT/JP2011/072547, filed on Sep. 30, 2011.

(30) Foreign Application Priority Data

Sep. 30, 2010 (JP) ..... 2010-223109
Sep. 30, 2010 (JP) ..... 2010-223111

(51) Int. Cl.
*B41J 2/35* (2006.01)

(52) U.S. Cl.
USPC ..... 347/211; 347/196; 347/191; 347/171; 347/195; 347/193

(58) Field of Classification Search
USPC ..... 347/211, 196, 193, 191
See application file for complete search history.

(56) References Cited

U.S. PATENT DOCUMENTS 4,567,488 A * 1/1986 Moriguchi et al. ..... 347/196
5,319,390 A 6/1994 Watanabe et al.
5,499,878 A * 3/1996 Morgavi ..... 400/223
5,625,399 A * 4/1997 Wiklof et al. ..... 347/195
6,377,290 B1 * 4/2002 Amiya et al. ..... 347/194
6,417,878 B2 7/2002 Tourai et al.

(Continued)

FOREIGN PATENT DOCUMENTS

EP 276978 A2 * 8/1988 ..... B41J 3/20
EP 478369 4/1992

(Continued)

OTHER PUBLICATIONS

Japanese Office Action issued in Application No. 2010-223109 on Apr. 1, 2014.

(Continued)

*Primary Examiner* — Matthew Luu
*Assistant Examiner* — Lily Kemathe
(74) *Attorney, Agent, or Firm* — McCarter & English, LLP

(57) ABSTRACT

A printer includes a thermal head including a line head in which heating elements are arranged in a straight line, a feed device being configured to feed a printing medium in a vertical scanning direction, and a control device being configured to control the feed device and the thermal head, the printer performing printing by forming a print dot by heating on the printing medium. Each iteration of the pulse application cycle is a time period from a main heating starting time to a next main heating starting time. The control device, in a case where the main heating is not performed on a second heating element adjacent in a main scanning direction to a first heating element, is configured to perform printing by using a first mode, in which applying of a first sub-pulse to the second heating element is performed starting from the main heating starting time.

5 Claims, 12 Drawing Sheets

(56) References Cited

U.S. PATENT DOCUMENTS

| | | | | |
|---|---|---|---|---|
| 7,830,405 | B2 * | 11/2010 | Liu et al. | 347/211 |
| 2001/0003462 | A1 | 6/2001 | Tourai | |
| 2004/0017434 | A1 * | 1/2004 | Okayasu et al. | 347/56 |
| 2009/0289976 | A1 * | 11/2009 | Nishimura et al. | 347/10 |

FOREIGN PATENT DOCUMENTS

| | | |
|---|---|---|
| JP | 1294068 | 11/1989 |
| JP | 4187457 | 7/1992 |
| JP | 5000529 | 1/1993 |
| JP | 7025052 | 1/1995 |
| JP | 7137327 | 5/1995 |
| JP | 7237314 | 9/1995 |
| JP | 7276695 | 10/1995 |
| JP | 2001150713 | 6/2001 |

OTHER PUBLICATIONS

International Search Report, PCT/JP2011/072547.

* cited by examiner

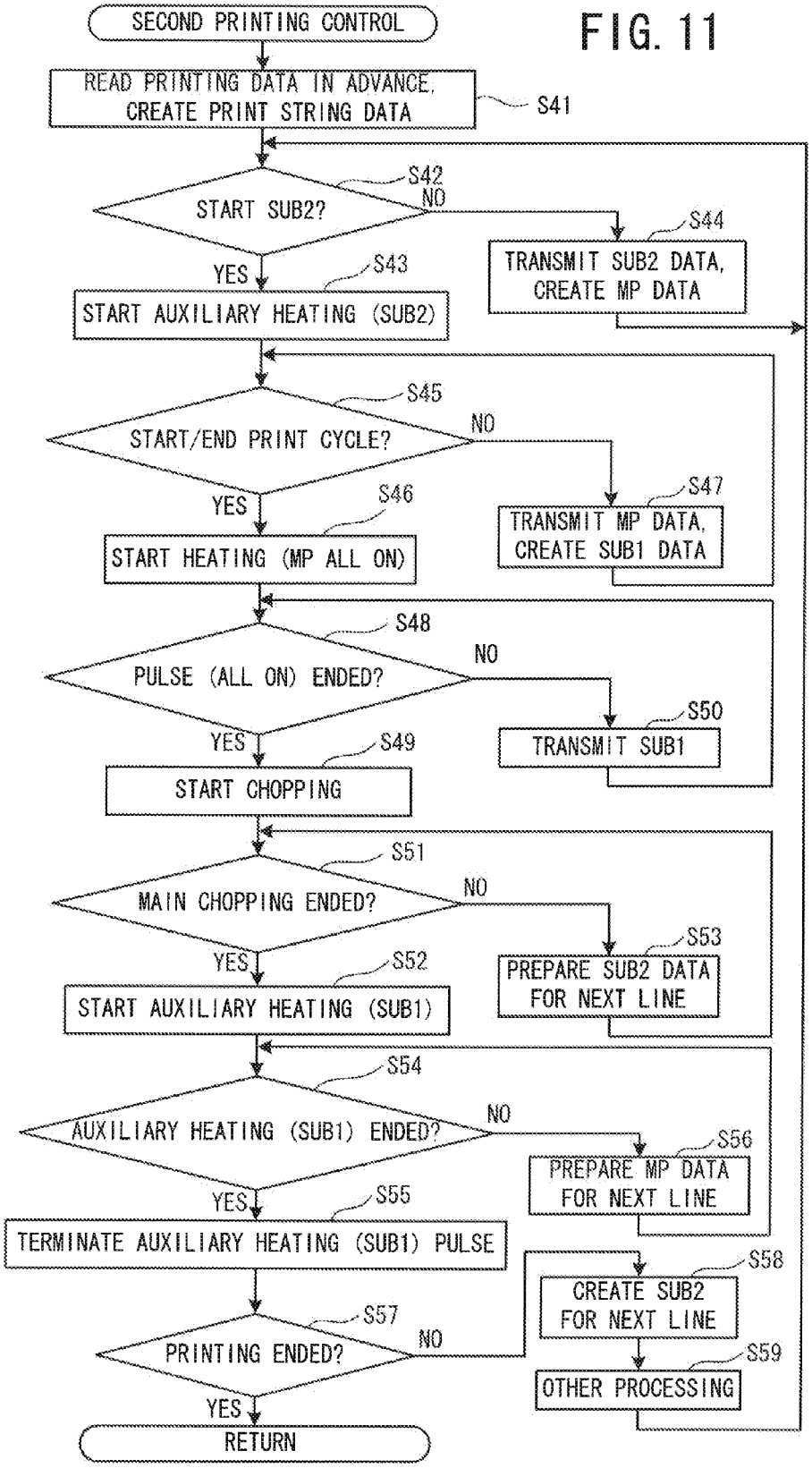
FIG. 11
SECOND PRINTING CONTROL
READ PRINTING DATA IN ADVANCE, CREATE PRINT STRING DATA
S41
START SUB2?
S42
NO
YES
S43
START AUXILIARY HEATING (SUB2)
S44
TRANSMIT SUB2 DATA, CREATE MP DATA
START/END PRINT CYCLE?
S45
NO
YES
S46
START HEATING (MP ALL ON)
S47
TRANSMIT MP DATA, CREATE SUB1 DATA
PULSE (ALL ON) ENDED?
S48
NO
YES
S49
START CHOPPING
S50
TRANSMIT SUB1
MAIN CHOPPING ENDED?
S51
NO
YES
S52
START AUXILIARY HEATING (SUB1)
S53
PREPARE SUB2 DATA FOR NEXT LINE
AUXILIARY HEATING (SUB1) ENDED?
S54
NO
YES
S55
TERMINATE AUXILIARY HEATING (SUB1) PULSE
S56
PREPARE MP DATA FOR NEXT LINE
S58
CREATE SUB2 FOR NEXT LINE
PRINTING ENDED?
S57
NO
YES
S59
OTHER PROCESSING
RETURN

PRINTER

CROSS-REFERENCE TO RELATED APPLICATION

This application is a continuation-in-part of International Application No. PCT/JP2011/072547, filed Sep. 30, 2011, which claims priority from Japanese Patent Application Nos. 2010-223109 and 2010-223111, respectively filed on Sep. 30, 2010. The disclosure of the foregoing application is hereby incorporated by reference in its entirety.

BACKGROUND

The present disclosure relates to a printer in which a thermal head is mounted.

Tape printers are known that perform printing on a tape discharged from a tape cassette contained inside a housing and that discharge the printed tape to the outside. The tape printers include a printer that uses a thermal head to print directly on a heat-sensitive tape and a printer that uses a thermal head to print by transferring from an ink ribbon to a tape. In a printer in which a thermal head is mounted, temperature control is required for each of heating elements included in the thermal head, in order to print, without blurring, a dot that is to be printed and not to print a dot that is not to be printed. With the temperature control for each of the heating elements included in the thermal head, within a print cycle during which one print dot is formed on a printing medium, there exist a heating period, during which main pulses are applied in order to heat the heating element and perform the printing, and a non-heating period for cooling the heated heating element.

When the printing starts, and even when an isolated print dot is formed on the printing medium during the printing, even if the heating element is heated by the applying of the main pulses, a portion of the heat may escape to the area around the heating element, so the heat that is generated may be slightly insufficient. Furthermore, even if the heating element is heated by the applying of the main pulses, when the heating elements that are adjacent to the heated heating element do not perform printing, the heat from the heated heating element may escape to the heating elements that do not perform printing, so in the same manner, the heat that is generated may be slightly insufficient. Moreover, even if the heating element is heated by the applying of the main pulses, when that particular heating element was not heated during the immediately preceding print cycle, the temperature of the heating element when the main pulses start to be applied may be lower than it would be if the heating element had been heated during the immediately preceding print cycle, and the increase in the temperature of the heating element may be delayed, so the heat that is generated may be slightly insufficient.

Accordingly, a printer has been proposed that uses a thermal head that applies sub-pulses that provide auxiliary heating to the heating element during the print cycle in order to compensate for the insufficiency of the heat that is generated (for example, refer to Patent Literature 1). In the printer, a period for the auxiliary heating by the sub-pulses may be added directly after the period for the heating by the main pulses. Therefore, the period for the heating by the main pulses, the period for the heating by the sub-pulses, and the non-heating period may be included in a single print cycle.

However, as the printing speed is increased, the print cycle may be shortened. It may therefore be necessary to make the periods for the heating by the main pulses and the sub-pulses shorter in accordance with the shortened print cycle. That may solve the time problem, but in order to heat the heating elements such that insufficiency in the amounts of heat that is generated does not occur in the shortened heating periods, it is necessary either to increase the applied voltage or to reduce the resistance values of the heating elements of the thermal head and to increase the electric current that flows to the heating elements of the thermal head. In order to do that, it becomes necessary to increase the voltage withstanding capacity and the current capacity of the integrated circuits for the drive circuit for the thermal head.

It is conceivable that the efficiency with which the heat that is generated by the heating elements of the thermal head is conducted to the printing medium could be improved. In order to do that, it may be necessary to improve the performance of the thin film portion of the thermal head that includes the heating elements in conducting heat to the printing medium. However, no matter which solution is implemented, an increase in cost may not be avoided.

SUMMARY

However, even in a case where neither of the solutions described above are be implemented, it may be necessary to shorten the print cycle in a case where the printing speed is to be increased. In order to ensure the amount of heat generation that is required for printing within the shortened print cycle, the ratio of the time that is occupied by the periods for the heating by the main pulses and the sub-pulses may be increased, therefore, the ratio that is occupied by the non-heating period may be decreased. In particular, in printing at high speed, when the printing starts, and when an isolated print dot is formed on the printing medium during the printing, even if the heating element is heated by the applying of the main pulses, a portion of the heat may escape to the area around the heating element. Therefore, the heat that a heating element generates may be slightly insufficient, and an abnormality may occur in the printing quality, such as blurring of the printed dots and the like. Furthermore, during low-speed printing, a larger amount of printing energy may be required than is needed for high-speed printing, in order to perform the auxiliary heating of the heating elements, and the auxiliary heating that is the same as for the high-speed printing may cause blurring in the printed dot.

Various embodiments of the broad principles derived herein provide a printer that is capable of high-speed printing without any blurring of the printed dot when the printing starts, and when an isolated print dot is formed on the printing medium during the printing.

Embodiments provide a printer that includes a thermal head, a feed device, and a control device. The thermal head includes a line head in which heating elements are arranged in a straight line. The feed device is configured to feed a printing medium in a vertical scanning direction orthogonal to a main scanning direction. The control device is configured to control the feed device and the thermal head. The printer performs printing by forming a print dot by heating on the printing medium that is fed by the feed device in the vertical scanning direction of the thermal head. The printing medium is heated, in each iteration of a pulse application cycle that is sequentially repeated, by the control device's performing of pulse applying processing for selectively heating the heating elements that are arranged in the line head of the thermal head. The main scanning direction is a direction in which the heating elements are arranged in the single line in the line head. Each iteration of the pulse application cycle is a time period from a main heating starting time to a next main heating starting time. The main heating starting time is a time at which applying of main pulses is started in the line head of the thermal head, in order to form on the printing medium a series of print dots in the vertical scanning direction of the thermal head. The main pulses are configured to implement main heating for forming the print dot on the printing medium. The control device, in a case where the main heating by the main pulses is not performed on a second heating element that is adjacent in a main scanning direction to a first heating element for which the main heating is performed by the main pulses, is configured to perform printing by using a first mode, in which applying of a first sub-pulse to the second heating element is performed starting from the main heating starting time. The first sub-pulse is configured to implement auxiliary heating that cannot form the print dot on the printing medium just by the applying of the first sub-pulse and that supplements the main heating of the first heating element by the main pulses.

BRIEF DESCRIPTION OF THE DRAWINGS

Embodiments will be described below in detail with reference to the accompanying drawings in which:

FIG. 11 is a flowchart that shows a control program of a second printing control of the thermal head 41 during the low-speed printing.

DETAILED DESCRIPTION

Figure 1:
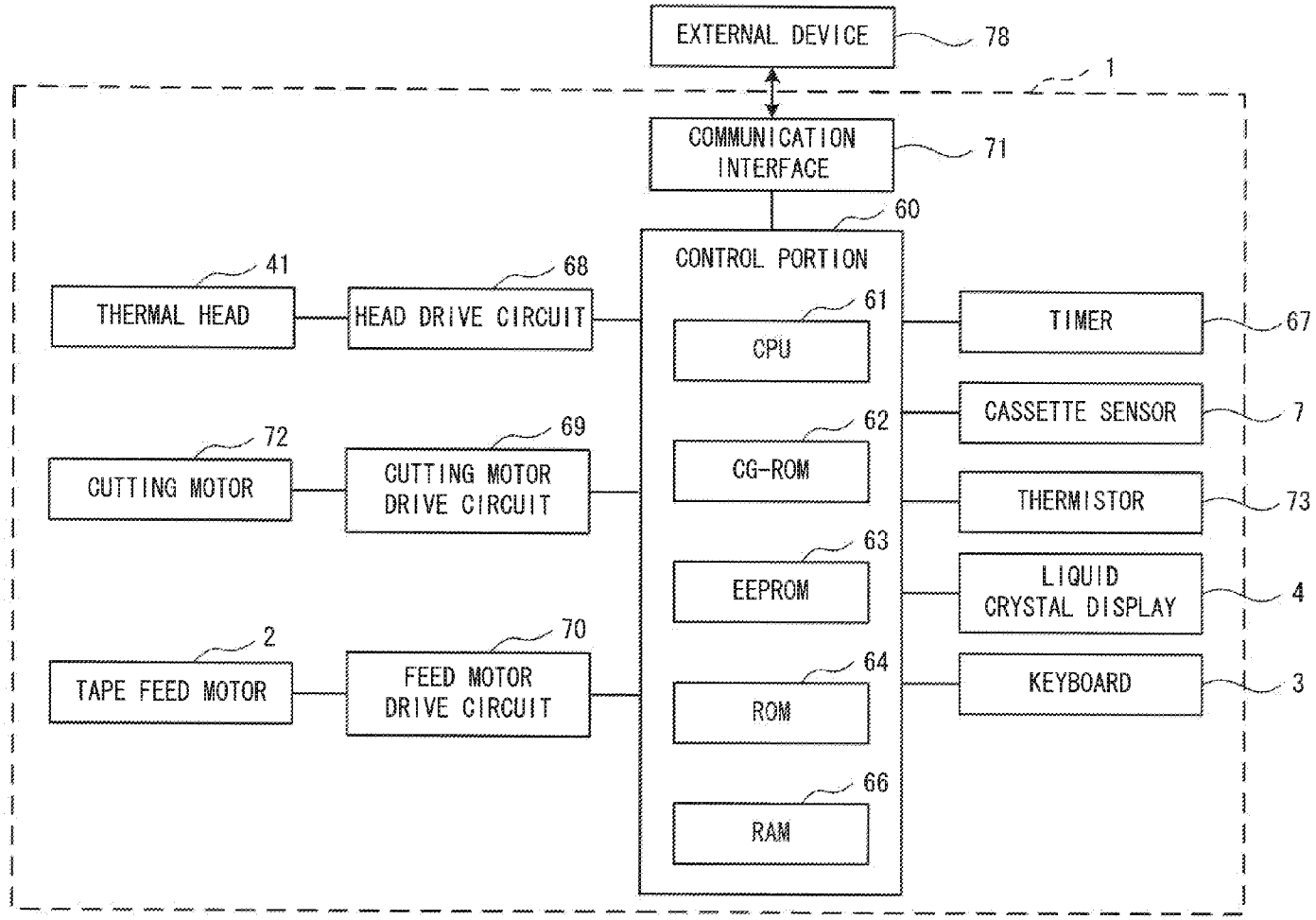
FIG. 1 is a block diagram that shows an electrical configuration of a tape printer 1.

Hereinafter, a configuration of a tape printer 1 according to a first embodiment of the present invention will be explained with reference to FIG. 1. The tape printer 1 is a printer that performs printing on a tape that is discharged from a tape cassette (not shown in the drawings) that is contained inside a housing, then discharges the printed tape to the outside, and the tape printer 1 includes a keyboard 3 and a liquid crystal display 4 on the top of the housing that is not shown in the drawings. The tape printer 1 may be connected by wire or wirelessly to an external device (for example, a personal computer or the like) via a connection interface 71. It is therefore possible for the tape printer 1 to print printing data that have been transmitted from the external device. In the tape printer 1 according to the present embodiment, in a case of high-speed printing (for example, a case where the feeding speed of the printing medium is greater than 40 millimeters per second), auxiliary heating for a print dot that is adjacent to a current print dot in a main scanning direction may be performed by a first printing control that will be described below on a heating element that is positioned opposite the adjacent print dot. Further, in a case of low-speed printing (for example, a case where the feeding speed of the printing medium is not greater than 40 millimeters per second), the auxiliary heating for the print dot that is adjacent to the current print dot in the main scanning direction is performed such that the auxiliary heating may be performed within a print cycle for the current print dot.

Next, an electrical configuration of the tape printer 1 will be described in detail with reference to FIG. 1. A control board (not shown in the drawings) is provided inside the tape printer 1, and a control portion 60, a timer 67, a head drive circuit 68, a cutting motor drive circuit 69, and a feed motor drive circuit 70 are provided on the control board.

The control portion 60 includes a CPU 61, a CG-ROM 62, an EEPROM 63, a ROM 64, and a RAM 66. The control portion 60 is connected to the timer 67, the head drive circuit 68, the cutting motor drive circuit 69, and the feed motor drive circuit 70. The control portion 60 is also connected to the liquid crystal display 4, a cassette sensor 7, a thermistor 73, the keyboard 3, and the connection interface 71. The CPU 61 is a central processing unit that plays a central role in various types of control in the tape printer 1. Accordingly, the CPU 61 may control individual peripheral devices, such as the liquid crystal display 4 and the like, based on an input signal from the keyboard 3 and the like and on various types of control programs that will be described below. In addition, a thermal head 41 is connected to the head drive circuit 68, a cutting motor 72 is connected to the cutting motor drive circuit 69, and a tape feed motor 2 is connected to the feed motor drive circuit 70.

The CG-ROM 62 is a character generator memory that may store image data of characters and symbols to be printed as dot patterns that correspond to code data. The EEPROM 63 is a non-volatile memory to which stored content can be written and from which the content can be deleted, and may store data that indicate user settings and the like in the tape printer 1. The ROM 64 may store various types of control programs and data for the tape printer 1. Accordingly, the ROM 64 may store the control programs that will be described below.

Figure 2:
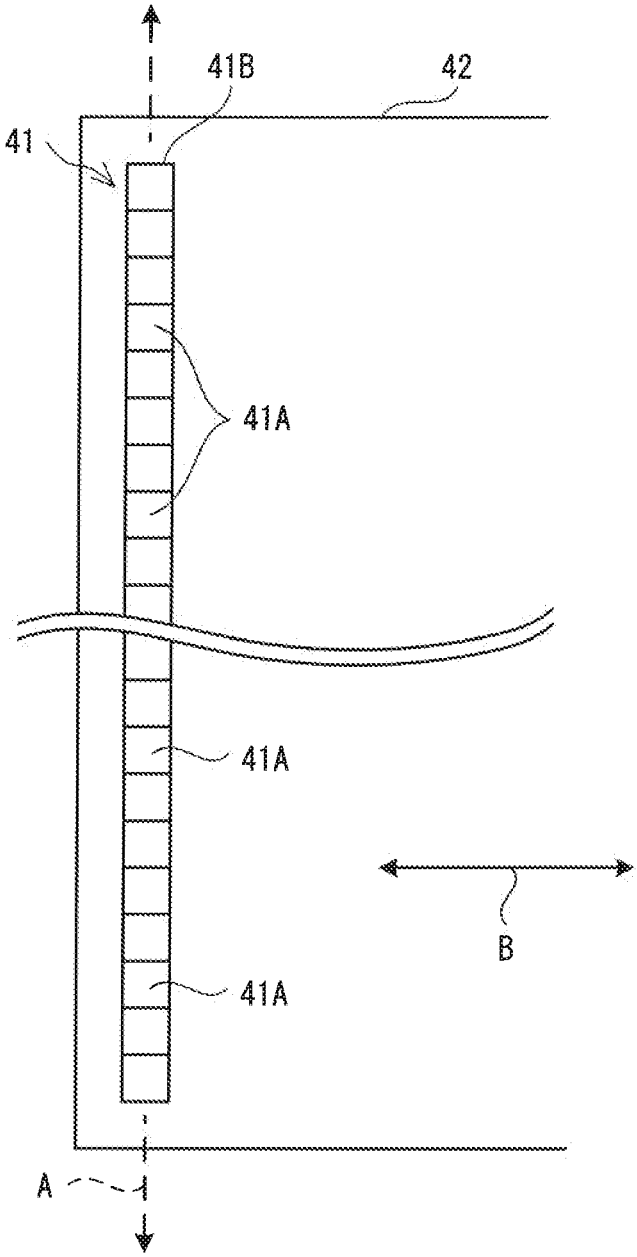
FIG. 2 is an enlarged view of a thermal head 41 of the tape printer 1 according to an embodiment of the present invention.

The RAM 66 is a storage device that may temporarily store computation results and the like from the CPU 61. The RAM 66 may store printing data that have been created based on an input from the keyboard 3 and printing data that have been acquired from an external device 78 via the communication interface 71. The timer 67 is a time measurement device that may measure a specified time period that elapses while control of the tape printer 1 is being performed. Specifically, in a control program that will be described below, the timer 67 may be referenced when a determination is made as to whether to start or terminate application of electric currents (pulses) or the like to heating elements 41A of the thermal head 41 that are shown in FIG. 2. The thermistor 73 is a sensor that may be used to detect the temperature of the thermal head 41, and is attached to the thermal head 41.

The head drive circuit 68 is a circuit that, based on a control signal from the CPU 61, may supply a drive signal to the thermal head 41 and may control the operating state of the thermal head 41, based on a control program that will be described below. At this time, the head drive circuit 68 may control the state of heat generation of the entire thermal head 41 by controlling the application of the electric currents (the pulses) to the individual heating elements 41A, based on signals (strobe (STB) signals) that are correlated to strobe numbers that correspond to the individual heating elements 41A. The cutting motor drive circuit 69 is a circuit that, based on a control signal from the CPU 61, may supply a drive signal to the cutting motor 72 and may control the operating state of the cutting motor 72. The feed motor drive circuit 70 is a control circuit that, based on a control signal from the CPU 61, may supply a drive signal to the tape feed motor 2 and may control the operating state of the tape feed motor 2.

Next, the structure of the thermal head 41 will be explained with reference to FIG. 2. As shown in FIG. 2, the thermal head 41 includes a line head 41B, in which a plurality (for example, 384, 1024, or 2048) of the heating elements 41A are provided in a single line, and the like. The direction in which the heating elements 41A are arranged in the single line is a main scanning direction A of the thermal head 41. In contrast to this, the direction that is orthogonal to the main scanning direction A of the thermal head 41 is a vertical scanning direction B of the thermal head 41. The thermal head 41 is affixed to a plate 42.

Figure 3:
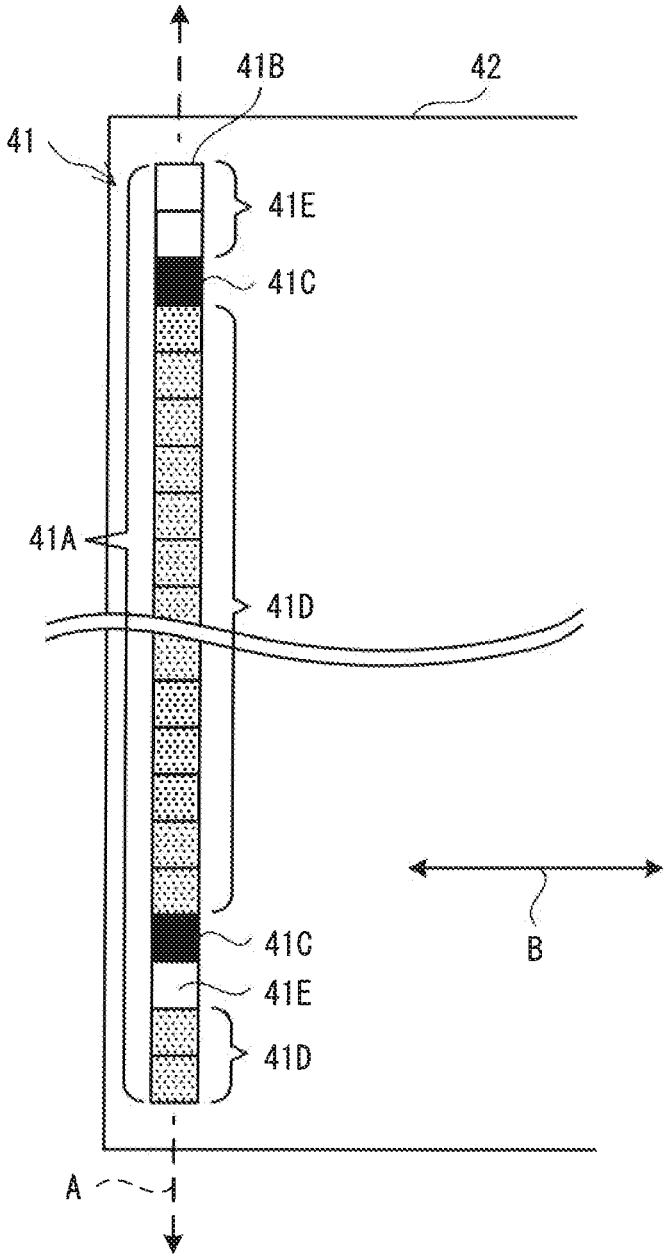
FIG. 3 is a figure that shows operating states of individual heating elements of the thermal head 41 of the tape printer 1.

In the present embodiment, when the thermal head 41 is operated and printing processing is performed one line at a time by the line head 41B, each of the plurality of the heating elements 41A that are included in the line head 41B may be put into one of the operating states (1) to (3) below, as shown in FIG. 3.

(1) A first heating element 41C that has been heated by main heating (2) A second heating element 41D that has been heated by auxiliary heating (3) A third heating element 41E that is not operated (for either the main heating or the auxiliary heating)

Figure 5:
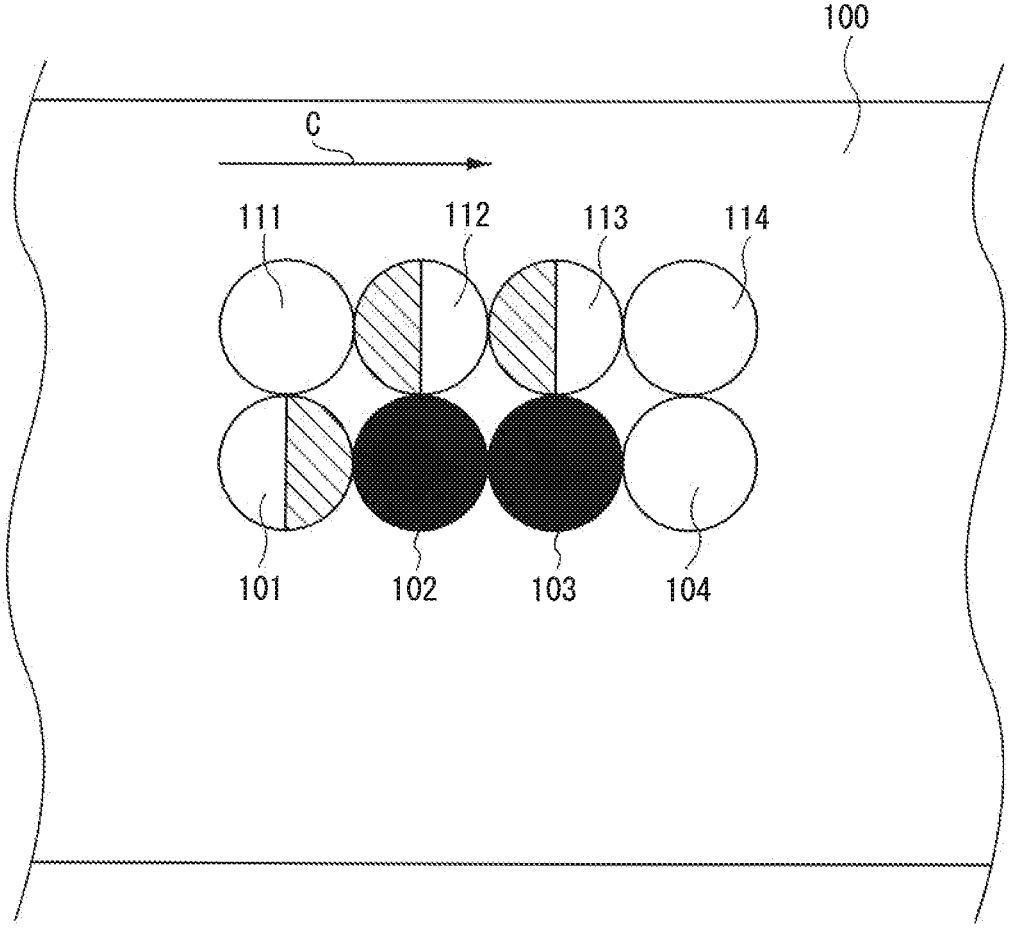
FIG. 5 is a figure that shows an example of print dots that are formed on a printing medium 100 by the thermal head 41 of the tape printer 1 during high-speed printing.

The main heating is an imparting of energy that can form a print dot on a printing medium 100 (refer to FIG. 5). Because an ink ribbon is used in the tape printer 1 according to the present embodiment, as will be described below, energy that can one of melt and sublimate the ink in the ink ribbon may be imparted to the heating element 41A that has been put into the operating state of the first heating element 41C by the performing of the main heating. A heat-sensitive tape may be used as the printing medium 100, instead of using the ink ribbon.

The auxiliary heating is an imparting of energy that cannot, by itself, form a print dot on the printing medium 100, but that can form a print dot on the printing medium 100 when combined with the main heating. Because the ink ribbon is used in the tape printer 1 according to the present embodiment, as will be described below, energy that can one of melt and sublimate the ink in the ink ribbon may not be imparted to the heating element 41A that has been put into the operating state of the second heating element 41D by the performing of the auxiliary heating.

Figure 4:
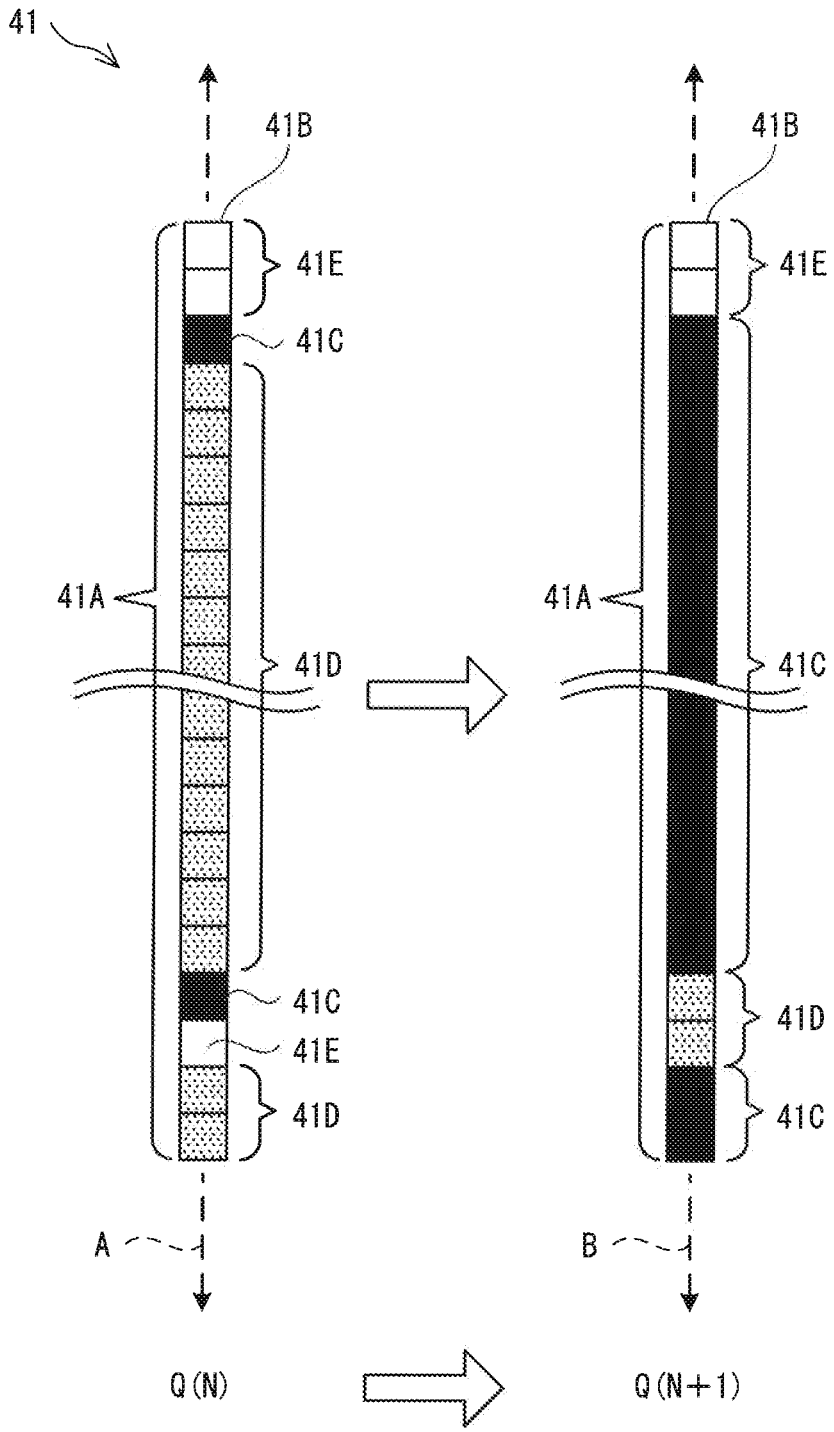
FIG. 4 is an explanatory figure that shows a condition under which auxiliary heating of the thermal head 41 of the tape printer 1 is performed.

Next, an example of the auxiliary heating in the vertical scanning direction will be explained with reference to FIG. 4. For example, in printing processing Q(N) for the current line, the auxiliary heating may be performed on the heating element 41A for which the main heating is not performed, and in printing processing Q(N+1) for the next line, the main heating may be performed, and the heating element 41A may be put into the operating state of the first heating element 41C.

Heat history control by the main heating and the auxiliary heating (operational control of the thermal head 41) and control of the pulses that are applied to the individual heating elements 41A that are included in the line head 41B of the thermal head 41 will be explained with reference to FIGS. 5, 6, and 7. In FIG. 7, the horizontal axis indicates time (t), and the vertical axis indicates the voltage value or the current value of the applied pulse. Therefore, in FIG. 7, the applied pulses are shown as low active, with the time elapsing from left to right.

FIG. 5 is a figure that shows an example of print dots that are formed on the printing medium 100 by the thermal head 41 of the tape printer 1 during high-speed printing, and in FIG. 5, the direction of an arrow C is the vertical scanning direction, while the direction that is orthogonal to the direction of the arrow C is the main scanning direction. As shown in FIG. 5, on the printing medium 100, the print dots 102 and 103 may be printed in sequence in the vertical scanning direction by the main heating of the heating elements 41A of the thermal head 41, and the dots 111, 112, 113, 114, 101, and 104 shows unprinted dots that are not printed.

As shown in FIG. 5, in a case where the print dot 102 is printed on the printing medium 100 by the one of the heating elements 41A that is shown in FIG. 3, but the dot 112, which is adjacent to the print dot 102 in the main scanning direction, is not printed on the printing medium 100 by the one of the heating elements 41A, and the dot 101, which immediately precedes the print dot 102 in the vertical scanning direction, is not printed on the printing medium 100 by the one of the heating elements 41A, the auxiliary heating for the heating element 41A of the thermal head 41 that is positioned opposite the dot 112 that is adjacent to the print dot 102 may be performed by sub-pulses SUB1, in order to compensate for the insufficiency of the heat that is generated by the heating element 41A of the thermal head 41 that may print the print dot 102. In addition, the auxiliary heating for the heating element 41A that is positioned opposite the unprinted dot 101 that immediately precedes the print dot 102 in the vertical scanning direction may be performed by sub-pulses SUB2, which will be described below. The dot 102 may therefore be printed without an insufficiency of energy, and blurring may not occur.

Figure 6:
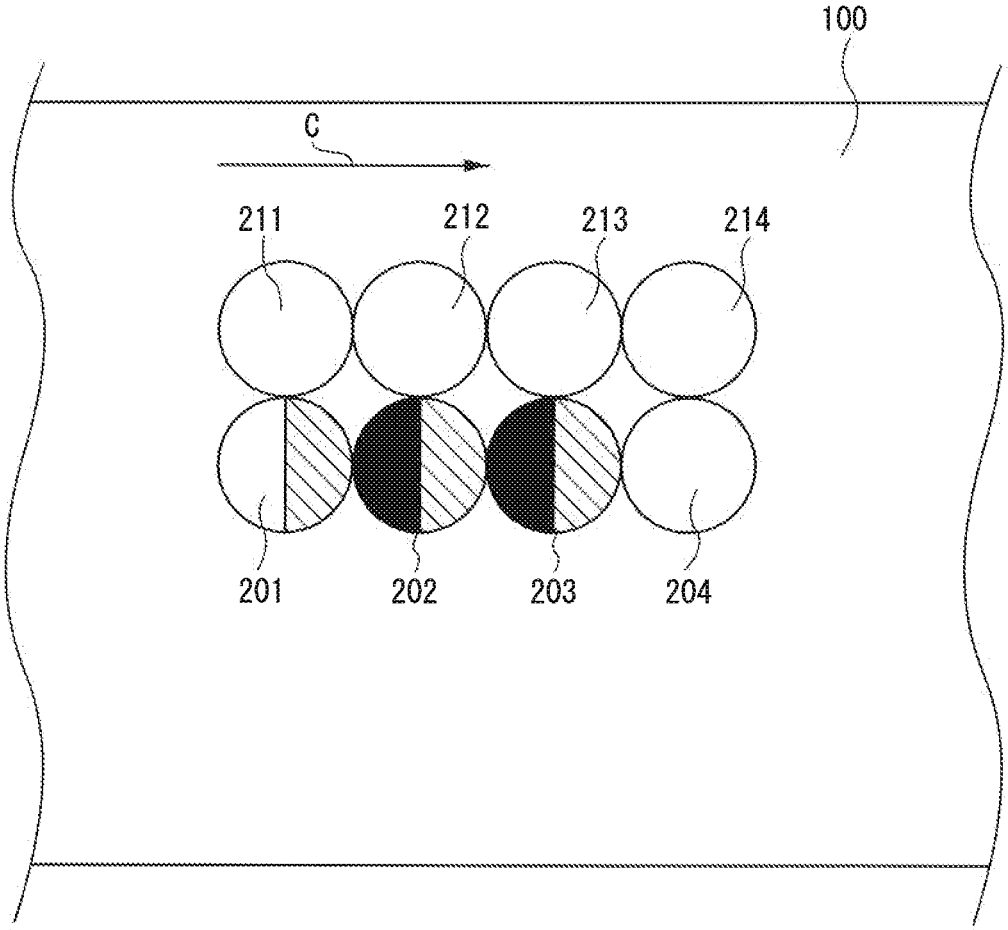
FIG. 6 is a figure that shows an example of print dots that are formed on the printing medium 100 by the thermal head 41 of the tape printer 1 during low-speed printing.
Figure 7:
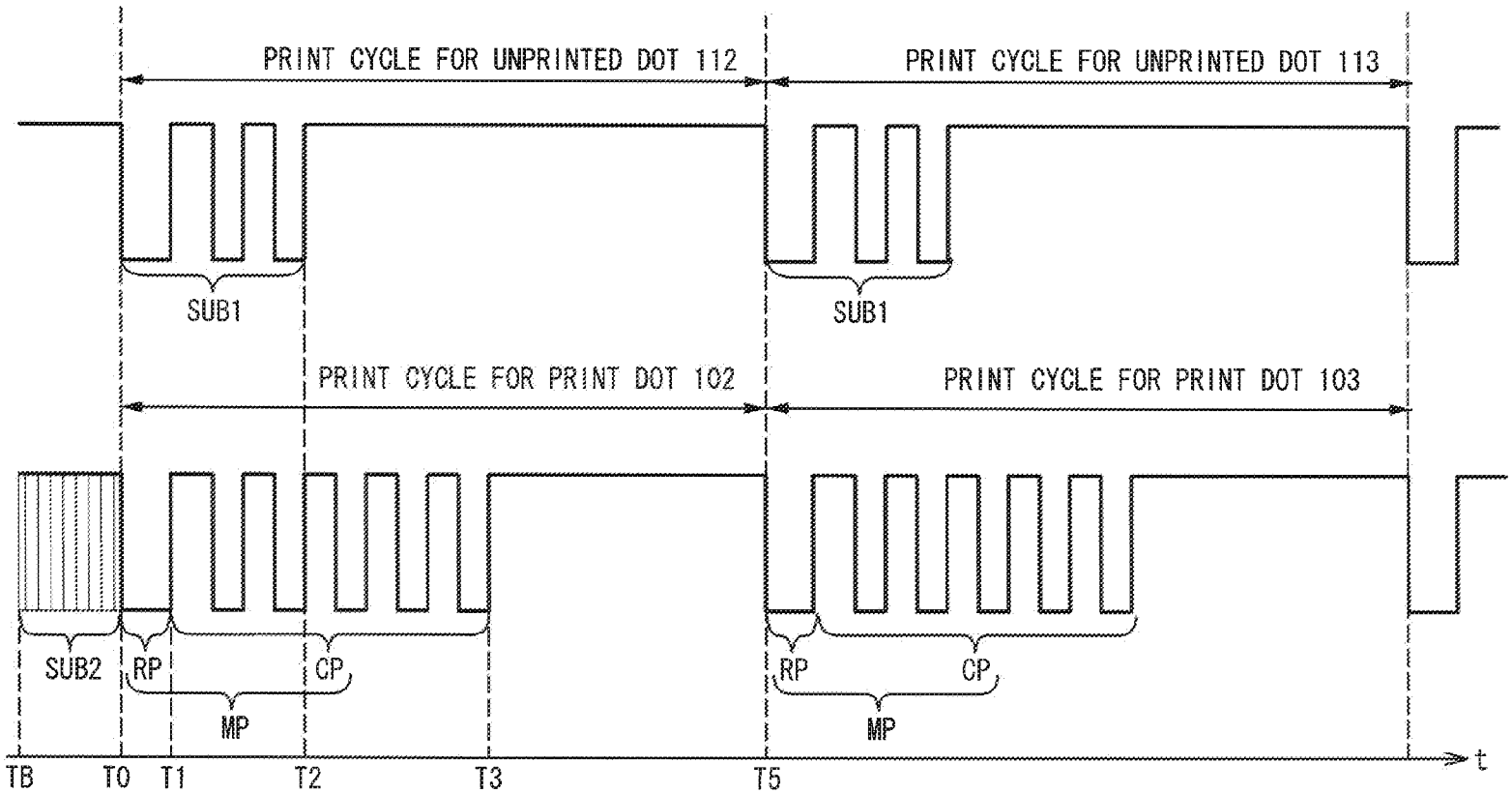
FIG. 7 is a timing chart of pulses that are applied to individual heating elements that are included in a line head of the thermal head 41 of the tape printer 1 during the high-speed printing.

FIG. 6 is a figure that shows an example of print dots that are formed on the printing medium 100 by the thermal head 41 of the tape printer 1 during low-speed printing, and in FIG. 6, the direction of the arrow C is the vertical scanning direction, while the direction that is orthogonal to the direction of the arrow C is the main scanning direction. As shown in FIG. 6, on the printing medium 100, the print dots 202 and 203 may be printed in sequence in the vertical scanning direction by the main heating of the heating elements 41A of the thermal head 41, and the dots 211, 212, 213, 214, 201, and 204 shows unprinted dots that are not printed.

As shown in FIG. 6, in a case where the print dot 202 is printed on the printing medium 100 by the one of the heating elements 41A that is shown in FIG. 3, but the dot 212, which is adjacent to the print dot 202 in the main scanning direction, is not printed on the printing medium 100 by the one of the heating elements 41A, and the dot 201, which immediately precedes the print dot 202 in the vertical scanning direction, is not printed on the printing medium 100 by the one of the heating elements 41A, the auxiliary heating for the heating element 41A of the thermal head 41 that may print the print dot 202 may be performed by the sub-pulses SUB1, which will be described below, in order to compensate for the insufficiency of the heat that is generated by the heating element 41A of the thermal head 41 that may print the print dot 202. In addition, the auxiliary heating for the unprinted dot 201 that immediately precedes the print dot 202 in the vertical scanning direction may be performed by the sub-pulses SUB2. The dot 202 may therefore be printed without an insufficiency of energy, and blurring may not occur.

Next, the main heating and the auxiliary heating of the heating elements 41A of the thermal head 41 during high-speed printing will be explained with reference to FIG. 5 and a timing chart for the applied pulses in FIG. 7. The pulses of the main heating by the heating element 41A of the thermal head 41 that may print the print dot 102 are main pulses MP that are shown in the lower part of FIG. 7. The main pulses MP include a basic pulse RP, which is a rectangular wave with a specified width, and chopping pulses CP. The dot 112 that is adjacent to the print dot 102 in the main scanning direction may not be printed, but the heating element 41A that is positioned opposite the dot 112 and is adjacent in the main scanning direction to the heating element 41A that may print the print dot 102 may be heated by the auxiliary heating. The pulses for the auxiliary heating of the heating element 41A for the dot that is adjacent in the main scanning direction are the sub-pulses SUB1 (refer to the upper part of FIG. 7). The sub-pulses SUB1 include of the basic pulse RP and a portion of the chopping pulses CP that are included in the main pulses MP. The length of the portion of the chopping pulses CP may be set to a length that is appropriate for preventing excessive heating, as determined by an printing experiment using the thermal head 41.

Furthermore, in a case where the dot 101 that immediately precedes the print dot 102 in the vertical scanning direction is not printed, the heating element 41A that is positioned opposite the dot 101 may be heated by the auxiliary heating. The pulses for the auxiliary heating of the heating element 41A that is positioned opposite the dot 101 that immediately precedes and is adjacent to the print dot 102 in the vertical scanning direction are the sub-pulses SUB2.

Figure 8:
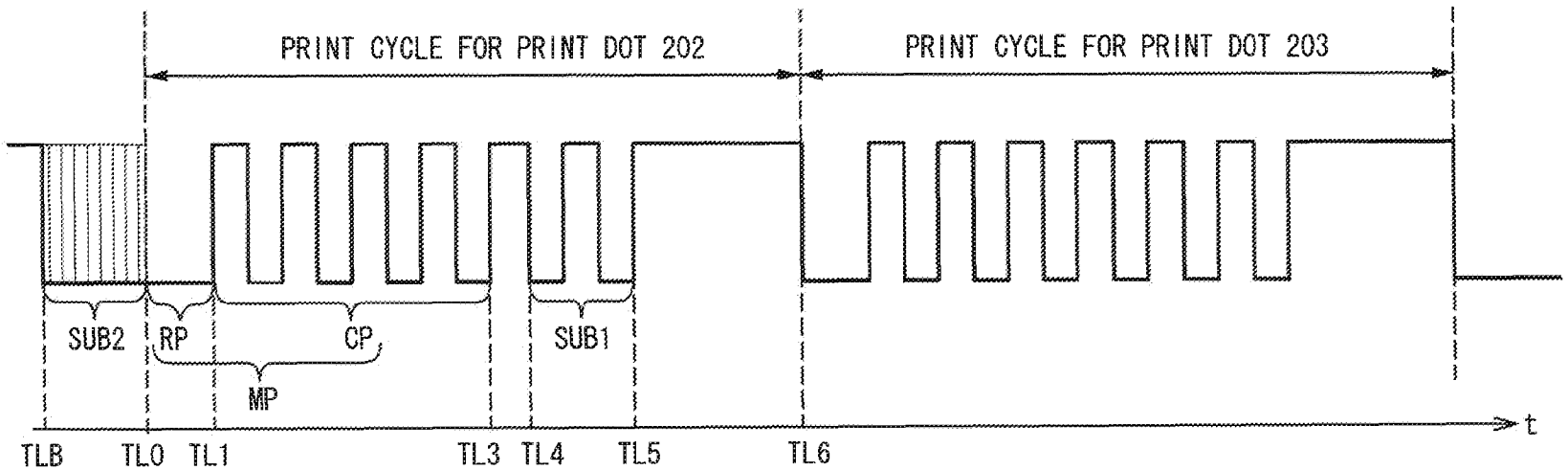
FIG. 8 is a timing chart of pulses that are applied to the individual heating elements that are included in the line head of the thermal head 41 of the tape printer 1 during the low-speed printing.

Next, the main heating and the auxiliary heating of the heating elements 41A of the thermal head 41 during low-speed printing will be explained with reference to FIG. 6 and a timing chart for the applied pulses in FIG. 8. The pulses of the main heating by the heating element 41A of the thermal head 41 that may print the print dot 202 are the main pulses MP that are shown in FIG. 8. The main pulses MP include the basic pulse RP, which is a rectangular wave with a specified width, and the chopping pulses CP. The dot 212 that is adjacent to the print dot 202 in the main scanning direction may not be printed, so the heating element 41A that may print the print dot 202 may be heated by the auxiliary heating. The pulses for the auxiliary heating are the sub-pulses SUB1. The sub-pulses SUB1 include a portion of the chopping pulses CP that are included in the main pulses MP. The length of the portion of the chopping pulses CP may be set to a length that is appropriate for preventing excessive heating, as determined by a printing experiment using the thermal head 41. Furthermore, the sub-pulses SUB1 may be appended within the print cycle for the print dot 202. This is done because the printing of the print dot 202 may be low-speed printing, so there may be free time available within the length of the print cycle for the print dot 202. In addition, more energy may be required during low-speed printing than during high-speed printing for the print dot 202.

Furthermore, in a case where the dot 201 that immediately precedes the print dot 202 in the vertical scanning direction is not printed, the heating element 41A that is positioned opposite the dot 201 is heated by the auxiliary heating. The pulses for the auxiliary heating of the dot 201 that immediately precedes and is adjacent to the print dot 202 in the vertical scanning direction are the sub-pulses SUB2.

Next, the flow of the high-speed printing processing by the thermal head 41 will be explained with reference to the timing chart that is shown in FIG. 7. The print cycle for the current line (dot) may be executed as a single cycle from the time T0 to the time T5. In the print cycle for the current line, in a case where the printing processing is performed for the dot 102 that is shown in FIG. 5, for example, the basic pulse RP that is included in the main pulses MP may be applied to the heating element 41A that may print the dot 102 in the time interval from T0 to T1, and the chopping pulses CP that are included in the main pulses MP may be applied in the time interval from T1 to T3. Therefore, the heating element 41A may be heated by the main heating and may enter the operating state of the first heating element 41C, and the print dot 102 may be printed. The reason why the main pulses MP include the basic pulse RP and the chopping pulses CP is to prevent excessive heating by using the basic pulse RP to instantly heat the heating element 41A to a specified temperature in order to print the dot 102 and then performing control that uses the chopping pulses CP to maintain a constant temperature. Furthermore, because the dot 101 is not printed by the printing processing for the line before the current line, the auxiliary pulses SUB2 may be applied in advance to the heating element 41A that is positioned opposite the dot 101, in the final part of the print cycle that immediately precedes the current print cycle, in the time interval from TB to T0.

Furthermore, in the current print cycle for the dot 102, the sub-pulses SUB1 may be applied, in the time interval from T0 to T2, to the heating element 41A that is positioned opposite the unprinted dot 112 that is adjacent in the main scanning direction to the heating element that may print the dot 102. Specifically, as the sub-pulses SUB1, the base pulse RP that is included in the main pulses MP may be applied in the time interval from T0 to T1, and a portion of the chopping pulses CP that are included in the main pulses MP may be applied in the time interval from T1 to T2. Therefore, although the dot 112 that is adjacent to the dot 102 in the main scanning direction may not be printed, the heating element that may print the print dot 102 may not suffer an insufficiency of energy and may print without any blurring occurring in the print dot 102. The sub-pulses SUB1 include the basic pulse RP and a portion of the chopping pulses CP in order to complete the preparation of the data for the sub-pulses SUB1 sooner. The time period from T0 to T2 during which the sub-pulses SUB1 are applied is a longer time period than the time period during which the printing data for the line head 41B are switched.

Next, the flow of the low-speed printing processing by the thermal head 41 will be explained with reference to the timing chart that is shown in FIG. 8. The print cycle for the current line (dot) may be executed as a single cycle from the time TL0 to the time TL6. In the print cycle for the current line, in a case where the printing processing is performed for the dot 202 that is shown in FIG. 6, for example, the basic pulse RP that is included in the main pulses MP may be applied to the heating element 41A that may print the dot 202 in the time interval from TL0 to TL1, and the chopping pulses CP that are included in the main pulses MP may be applied in the time interval from TL1 to TL3. Therefore, the heating element 41A may be heated by the main heating and may enter the operating state of the first heating element 41C, and the print dot 202 may be printed. The reason why the main pulses MP include the basic pulse RP and the chopping pulses CP is to prevent excessive heating by using the basic pulse RP to instantly heat the heating element 41A to a specified temperature in order to print the dot 202 and then performing control that uses the chopping pulses CP to maintain a constant temperature. Furthermore, because the dot 201 is not printed by the printing processing for the line before the current line, the auxiliary pulses SUB2 may be applied in advance to the heating element 41A that is positioned opposite the dot 201, in the final part of the print cycle that immediately precedes the current print cycle, in the time interval from TLB to TL0.

Furthermore, in the current print cycle for the dot 202, the sub-pulses SUB1 may be applied, in the time interval from TL4 to TL5, to the heating element 41A that may print the dot 202, in order to compensate for the insufficiency of energy that occurs because the unprinted dot 212 that is adjacent to the dot 202 in the main scanning direction is not printed. Specifically, a portion of the chopping pulses CP that are included in the main pulses MP may be applied as the sub-pulses SUB1 in the time interval from TL4 to TL5. Therefore, although the dot 212 that is adjacent to the dot 202 in the main scanning direction may not be printed, the heating element that may print the print dot 202 may not suffer an insufficiency of energy and may print without any blurring occurring in the print dot 202. The sub-pulses SUB1 include a portion of the chopping pulses CP in order to complete the preparation of the data for the sub-pulses SUB1 sooner. The time period from TL4 to TL5 during which the sub-pulses SUB1 are applied is a longer time period than the time period during which the printing data for the line head 41B are switched.

Figure 9:
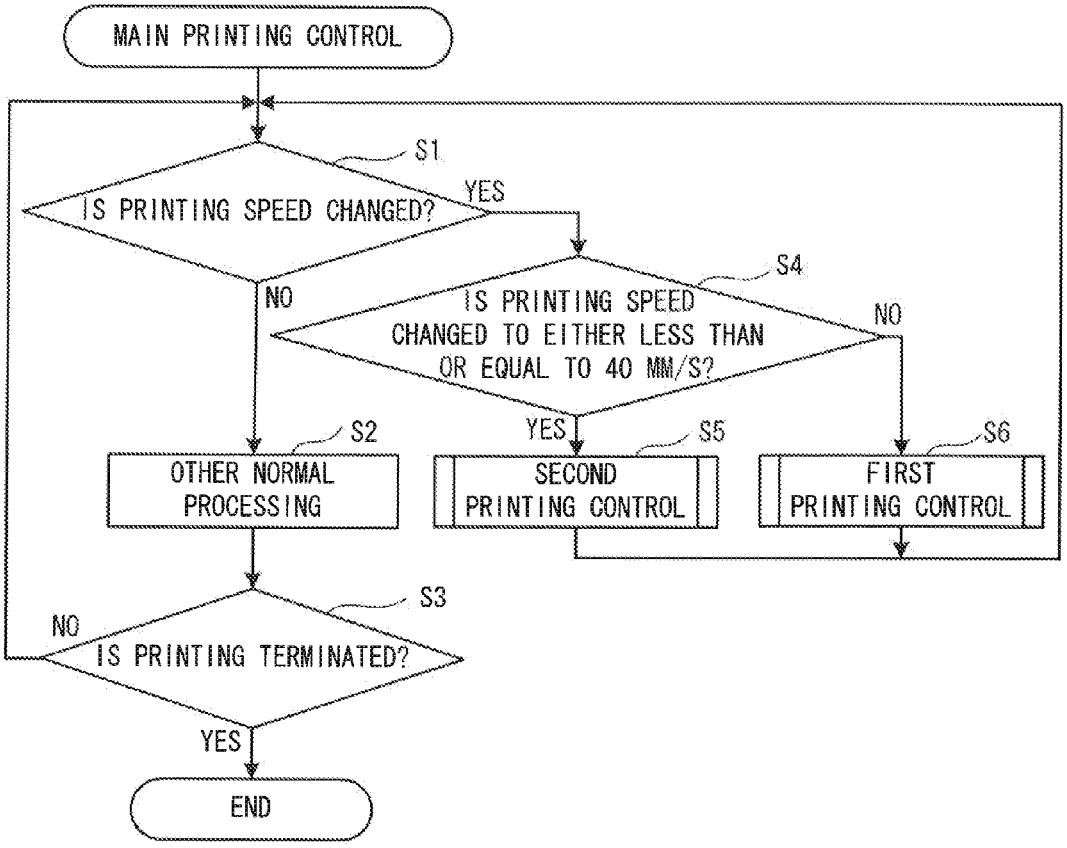
FIG. 9 is a flowchart that shows a control program for main printing control of the thermal head 41.
Figure 10:
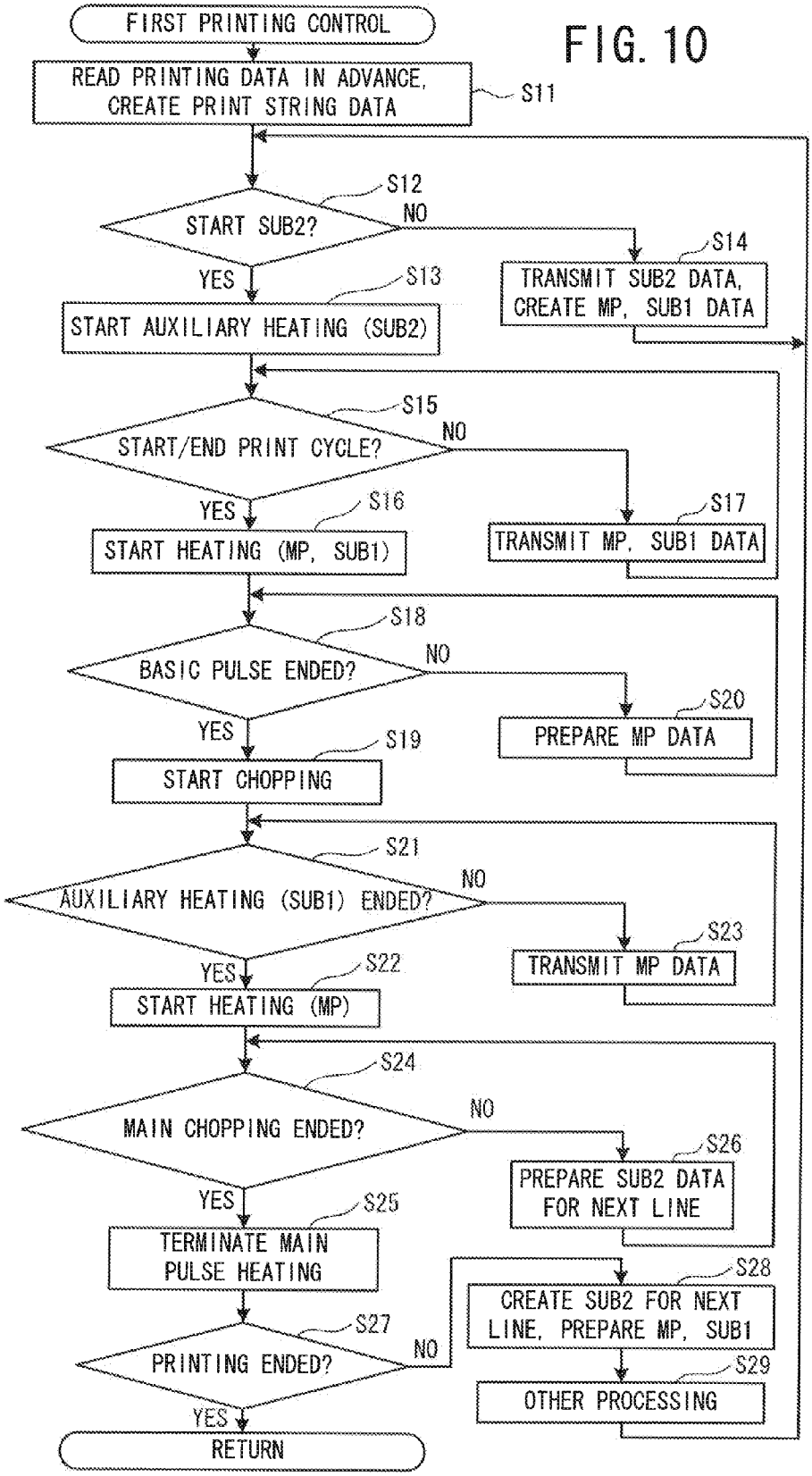
FIG. 10 is a flowchart that shows a control program of a first printing control of the thermal head 41 during the high-speed printing.

Next, the flow of the printing processing by the thermal head 41 will be explained with reference to the flowcharts that are shown in FIGS. 9 to 11. First, main printing control that is performed by the CPU 61 of the control portion 60 of the tape printer 1 will be explained with reference to FIG. 9. The control programs in the flowcharts that are shown in FIGS. 9 to 11 may be stored in the ROM 64 and may be executed by the CPU 61.

First, in the main printing control that is shown in FIG. 9, in a case where the CPU 61 detects, based on printing data or the like, that the printing speed is changed (YES at Step S1), a determination is made as to whether the printing speed is changed to either less than or equal to 40 millimeters per second (Step S4). In a case where the printing speed is changed to either less than or equal to 40 millimeters per second (YES at Step S4), the printing is to be performed by a second printing control (refer to FIG. 11), which is a low-speed printing control (Step S5). In a case where the printing speed is changed to greater than 40 millimeters per second (NO at Step S4), the printing is to be performed by the first printing control (refer to FIG. 10), which is a high-speed printing control (Step S6). The threshold value for high-speed printing and low-speed printing is not limited to 40 millimeters per second, and a suitable value may be determined by experimentation or the like, in accordance with the properties of the heating elements 41A of the thermal head 41 that is to be used and the heat sensitivity properties of the printing medium that is to be used. In a case where the printing speed is not to be changed (NO at Step S1), other normal processing is performed (Step S2), and in a case where the printing is not to be terminated (NO at Step S3), the processing returns to Step S1. In a case where the printing is to be terminated (YES at Step S3), the main printing control is terminated.

Next, the subroutine for the first printing control, in which high-speed printing is performed by the thermal head 41 of the tape printer 1, will be explained with reference to the flowchart in FIG. 10. The control program in the flowchart that is shown in FIG. 10 may be stored in the ROM 64 or the like and may be executed by the CPU 61.

As shown in FIG. 10, in the first printing control of the thermal head 41, first, the CPU 61 performs advance reading of the printing data from the RAM 66, checks a dot that conforms to an auxiliary heating condition, and creates thermal head print string data (sub-pulses SUB1, SUB2, main pulses MP) (Step S11). At this time, the CPU 61 creates the thermal head print string data such that one line's worth of the sub-pulse data and the main pulse data are prepared for each individual print cycle, based on the auxiliary heating condition. The auxiliary heating condition is such that, as an example, with respect to the sub-pulses SUB1, the dot that is adjacent in the main scanning direction to the dot that is to be printed is not to be printed. With respect to the sub-pulses SUB2, the auxiliary heating condition is such that the dot that immediately precedes, in the vertical scanning direction, the dot that is to be printed is not to be printed. The auxiliary heating conditions may be set by taking heat accumulation into consideration, in addition to the conditions described above, based on the printing histories of the heating elements 41A. Furthermore, for the one line's worth of the thermal head print string data for the initial print cycle, temperature information and the like that is set based on a temperature Z of the thermal head 41 that is detected by the thermistor 73 may be reflected in the setting of the applied pulse width for the sub-pulses SUB2. The one line's worth of the sub-pulse data and the main pulse data are set for each of the heating elements 41A that are included in the line head 41B of the thermal head 41.

In addition, at Step S11, the CPU 61 transmits the data for the sub-pulses SUB2 to the head drive circuit 68. Next, the CPU 61 determines whether the starting time for the sub-pulses SUB2 for the auxiliary heating has arrived (Step S12). The determination is made by using the timer 67 or the like. That is, a determination is made as to whether the time TB (refer to FIG. 7) at which the applying of the sub-pulses SUB2 to the heating element 41A of the thermal head 41 is started has arrived. In a case where the starting time for the sub-pulses SUB2 has not arrived (NO at Step S12), the CPU 61 transmits the data for the sub-pulses SUB2 to the head drive circuit 68 and creates the data for main pulses MP and the sub-pulses SUB1 (Step S14). Then the processing returns to Step S12 and waits until the time arrives to start the sub-pulses SUB2.

On the other hand, in a case where the starting time for the sub-pulses SUB2 has arrived (YES at Step S12), the CPU 61 starts the applying of the sub-pulses SUB2 to the heating elements 41A of the thermal head 41 (Step S13). That is, the CPU 61 latches the sub-pulse SUB2 data that have been transmitted at this time to the head drive circuit 68, sets the strobe (hereinafter referred to as the "STB") signal to LOW, and applies the sub-pulses SUB2 to the heating element 41A that is subject to the auxiliary heating, putting the heating element 41A into the operating state of the second heating element 41D (Step S13).

Next, the CPU 61 determines whether one of a starting time and an ending time (an ending time for the auxiliary heating by the sub-pulses SUB2) for the print cycle has arrived (Step S15). The determination is made by using the timer 67 or the like. That is, a determination is made as to whether the time T0 has arrived (refer to FIG. 7), which is the main heating starting time (the ending time for the auxiliary heating by the sub-pulses SUB2), at which the applying of the sub-pulses SUB2 is terminated and the applying of the main pulses MP is started (Step S15).

In a case where neither the starting time nor the ending time (the ending time for the auxiliary heating by the sub-pulses SUB2) for the print cycle has arrived (NO at Step S15), the CPU 61 transmits the data for the main pulses MP and the sub-pulses SUB1 that are eligible for transmission at this time to the head drive circuit 68 only one time (Step S17). Then the CPU 61 returns to Step S15.

On the other hand, in a case where one of the starting time and the ending time for the print cycle has arrived (YES at Step S15), the CPU 61 starts the heating by the main pulses MP and the sub-pulses SUB1 (Step S16). That is, the CPU 61 latches the data for the main pulses MP and the sub-pulses SUB1 that were transmitted to the head drive circuit 68 at the aforementioned Step S17 and applies the main pulses MP to the heating element 41A that is subject to the main heating, putting the heating elements 41A into the operating state of the first heating element 41C (Step S16). The CPU 61 also applies the sub-pulses SUB1 to the heating element 41A that is adjacent in the main scanning direction to the heating element 41A that is subject to the main heating, putting the adjacent heating element 41A into the operating state of the second heating element 41D. This maintains the STB signal at the LOW setting.

Next, a determination is made as to whether the time period for the basic pulse RP has ended (Step S18). Specifically, in a case where the time T1 has arrived at which the time period for the basic pulse RP ends (YES at Step S18), the applying of the chopping pulses CP is started (Step S19). The chopping pulses CP may be implemented by repeatedly turning the STB signal on and off. In a case where the time period for the basic pulse RP has not ended in the time interval between T0 and T1 (NO at Step S18), only the main pulses MP are prepared (Step S20), and the processing returns to the determination processing at Step S18.

Next, during the time interval until the ending time (T2) for the sub-pulses SUB1 arrives (NO at Step S21), the data for the main pulses MP are transmitted to the head drive circuit 68 (Step S23). In a case where the ending time (T2) for the sub-pulses SUB1 has arrived (YES at Step S21), the CPU 61 starts the heating by the main pulses MP (Step S22). That is, the CPU 61 latches the data for the main pulses MP that were transmitted to the head drive circuit 68 at the aforementioned Step S23 and applies the main pulses MP to the heating element 41A that is subject to the main heating, putting the heating element 41A into the operating state of the first heating element 41C. In addition, the chopping by the chopping pulses CP is continued (Step S22).

Figure 12:
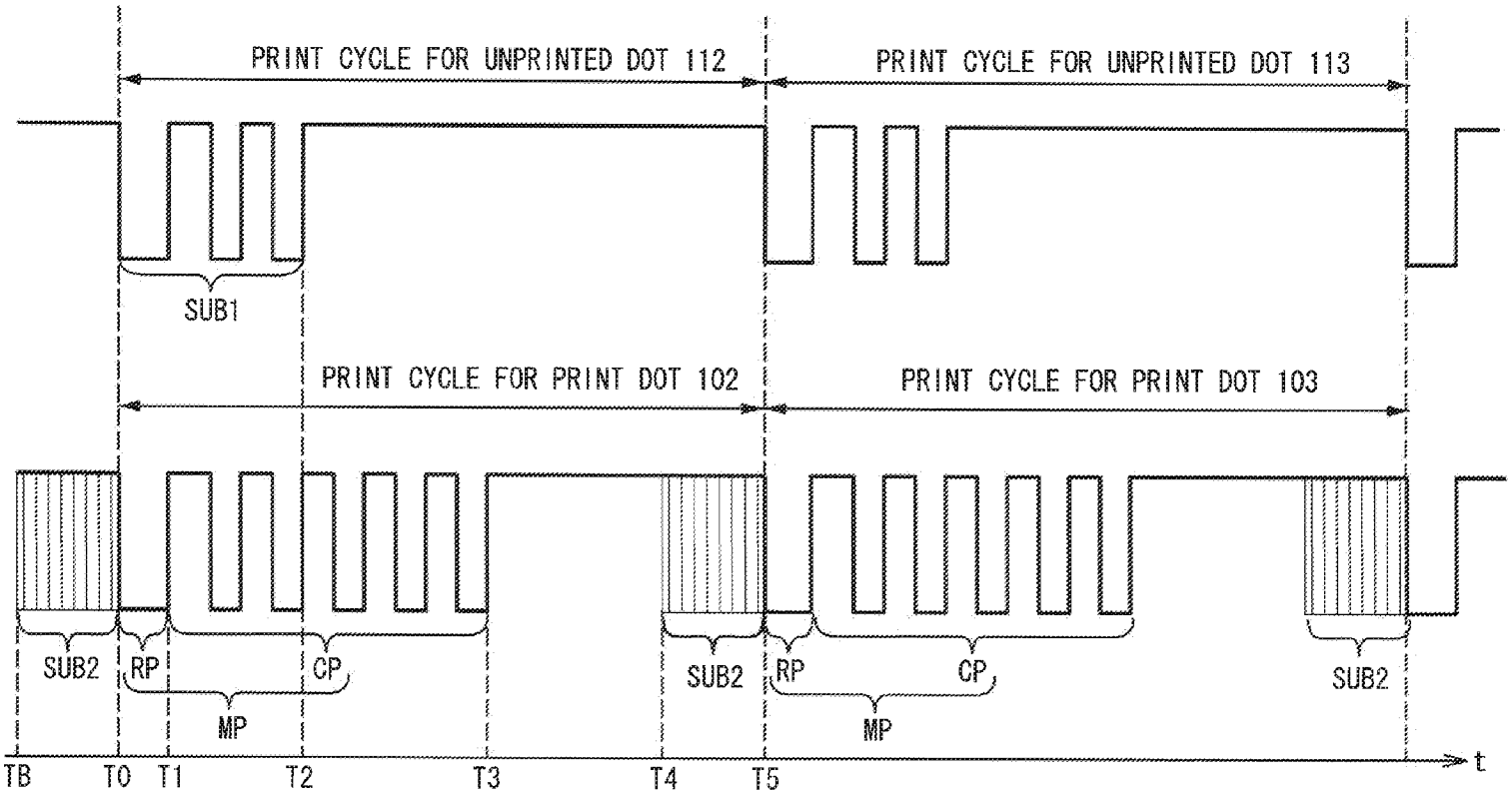
FIG. 12 is a timing chart of pulses that are applied to the individual heating elements that are included in the line head of the thermal head 41, for explaining preparation of data for sub-pulses SUB2 for the next line.

Next, until the ending time for the chopping pulses CP of the main pulses MP arrives (NO at Step S24), the data for the sub-pulses SUB2 for the next line are prepared (Step S26). (As an example, the sub-pulses SUB2 that are shown starting at the time T4 in FIG. 12 are prepared. In a case where there are no data for the sub-pulses SUB2 for the next line, the timing chart that is shown in FIG. 7 comes into effect.) In a case where the ending time for the chopping pulses CP of the main pulses MP has arrived (YES at Step S24), the STB signal is set to HI, and the heating element 41A is turned off (Step S25).

Next, in a case where unprinted printing data remain and the printing has not ended (NO at Step S27), the creating of the sub-pulses SUB2 for the next line and the preparation of the main pulses MP and the sub-pulses SUB1 are performed (Step S28), other processing (margin time) is performed (Step S29), the processing returns to Step S12, and the processing from Step S12 to Step S27 is repeated. In a case where there are no unprinted printing data and the printing has ended (YES at Step S27), the printing processing is terminated, and the processing returns to the main printing control that is shown in FIG. 9.

Next, the subroutine for the second printing control, in which low-speed printing is performed by the thermal head 41 of the tape printer 1, will be explained with reference to the flowchart in FIG. 11. The control program in the flowchart that is shown in FIG. 11 may be stored in the ROM 64 or the like and may be executed by the CPU 61.

As shown in FIG. 11, in the second printing control of the thermal head 41, first, the CPU 61 performs advance reading of the printing data from the RAM 66, checks a dot that conforms to the auxiliary heating condition, and creates the thermal head print string data (sub-pulses SUB1, SUB2, main pulses MP) (Step S41). At this time, the CPU 61 creates the thermal head print string data such that one line's worth of the sub-pulse data and the main pulse data are prepared for each individual print cycle, based on the auxiliary heating condition. The auxiliary heating condition is such that, as an example, with respect to the sub-pulses SUB1, the dot that is adjacent in the main scanning direction to the dot that is to be printed is not to be printed. With respect to the sub-pulses SUB2, the auxiliary heating condition is such that the dot that immediately precedes, in the vertical scanning direction, the dot that is to be printed is not to be printed. The auxiliary heating condition may be set by taking heat accumulation into consideration, in addition to the conditions described above, based on the printing histories of the heating elements 41A. Furthermore, for the one line's worth of the thermal head print string data for the initial print cycle, temperature information and the like that is set based on a temperature Z of the thermal head 41 that is detected by the thermistor 73 may be reflected in the setting of the applied pulse width for the sub-pulses SUB2. The one line's worth of the sub-pulse data and the main pulse data are set for each of the heating elements 41A that are included in the line head 41B of the thermal head 41.

In addition, at Step S41, the CPU 61 transmits the data for the sub-pulses SUB2 to the head drive circuit 68. Next, the CPU 61 determines whether the starting time for the sub-pulses SUB2 for the auxiliary heating has arrived (Step S42). The determination is made by using the timer 67 or the like. That is, a determination is made as to whether the time TLB (refer to FIG. 8) at which the applying of the sub-pulses SUB2 to the heating element 41A of the thermal head 41 is started has arrived. In a case where the starting time for the sub-pulses SUB2 has not arrived (NO at Step S42), the CPU 61 transmits the data for the sub-pulses SUB2 to the head drive circuit 68 and creates the data for main pulses MP (Step S44). Then the processing returns to Step S42 and waits until the time arrives to start the sub-pulses SUB2.

On the other hand, in a case where the starting time for the sub-pulses SUB2 has arrived (YES at Step S42), the CPU 61 starts the applying of the sub-pulses SUB2 to the heating element 41A of the thermal head 41 (Step S43). That is, the CPU 61 latches the data for the sub-pulse SUB2 that have been transmitted at this time to the head drive circuit 68, sets the strobe (hereinafter referred to as the "STB") signal to LOW, and applies the sub-pulses SUB2 to the heating element 41A that is subject to the auxiliary heating, putting the heating element 41A into the operating state of the second heating element 41D (Step S43).

Next, the CPU 61 determines whether one of the starting time and the ending time (the ending time for the auxiliary heating by the sub-pulses SUB2) for the print cycle has arrived (Step S45). The determination is made by using the timer 67 or the like. That is, a determination is made as to whether the time TL0 has arrived (refer to FIG. 8), which is the main heating starting time (the ending time for the auxiliary heating by the sub-pulses SUB2), at which the applying of the sub-pulses SUB2 is terminated and the applying of the main pulses MP is started (Step S45).

In a case where neither the starting time nor the ending time (the ending time for the auxiliary heating by the sub-pulses SUB2) for the print cycle has arrived (NO at Step S45), the CPU 61 transmits the data for the main pulses MP that are eligible for transmission at this time to the head drive circuit 68 only one time (Step S47). Then the CPU 61 returns to Step S45.

On the other hand, in a case where one of the starting time and the ending time for the print cycle has arrived (YES at Step S45), the CPU 61 starts the heating by the main pulses MP (Step S46). That is, the CPU 61 latches the data for the main pulses MP that were transmitted to the head drive circuit 68 at the aforementioned Step S47 and applies the main pulses MP to the heating element 41A that is subject to the main heating, putting the heating element 41A into the operating state of the first heating element 41C (Step S46). This maintains the STB signal at the LOW setting.

Next, a determination is made as to whether the time period for the basic pulse RP has ended (Step S48). Specifically, in a case where the time TL1 has arrived at which the time period for the base pulse RP ends (YES at Step S48), the applying of the chopping pulses CP is started (Step S49). The chopping pulses CP may be implemented by repeatedly turning the STB signal on and off. In a case where the time period for the basic pulse RP has not ended in the time interval between TL0 and TL1 (NO at Step S48), the data for the sub-pulses SUB1 are transmitted to the head drive circuit 68 (Step S50), and the processing returns to the determination processing at Step S48.

Next, until the ending time (TL3) for the chopping pulses CP of the main pulses MP arrives (NO at Step S51), the data for the sub-pulses SUB2 for the next line are prepared (Step S53). In a case where the ending time (TL3) for the chopping pulses CP of the main pulses MP has arrived (YES at Step S51), the CPU 61 starts the auxiliary heating by the sub-pulses SUB1 at the time TL4 (Step S52). That is, the CPU 61 latches the data for the sub-pulses SUB1 that were transmitted to the head drive circuit 68 at the aforementioned Step S50 and applies the sub-pulses SUB1 to the heating element 41A that is subject to the main heating, putting the heating element 41A into the operating state of the second heating element 41D. The chopping of the sub-pulses SUB1 is continued (Step S52).

Next, until the ending time for the chopping of the sub-pulses SUB1 arrives (NO at Step S54), the data for the main pulses MP for the next line are prepared (Step S56). (The data for the main pulses MP for the next line are prepared starting at the time TL4 that is shown in FIG. 8.) In a case where the ending time (TL5) for the chopping of the sub-pulses SUB1 has arrived (YES at Step S54), the STB signal is set to HI, and the heating element 41A is turned off (Step S55).

Next, in a case where unprinted printing data remain and the printing has not ended (NO at Step S57), the creating of the sub-pulses SUB2 for the next line is performed (Step S58), other processing (margin time) is performed (Step S59), the processing returns to Step S42, and the processing from Step S42 to Step S57 is repeated. In a case where there are no unprinted printing data and the printing has ended (YES at Step S57), the printing processing is terminated, and the processing returns to the main printing control that is shown in FIG. 9.

As explained above, in the tape printer 1 according to the present embodiment, in a case where the print dot 102 is printed on the printing medium 100, when the dot 112 that is adjacent to the print dot 102 in the main scanning direction is not to be printed on the printing medium 100, in the high-speed printing, the sub-pulses SUB1 may be applied to the heating element 41A that is positioned opposite the dot 112 that is adjacent to the print dot 102 in the main scanning direction. In the low-speed printing, the sub-pulses SUB1 may be applied to the heating element 41A that may print the print dot 102. Therefore, no matter what the printing speed, the heating element 41A that may print the print dot 102 may not suffer an insufficiency of energy, and blurring of the print dot 102 may be prevented. In a case where the dot 101 that immediately precedes the print dot 102 in the vertical scanning direction is not to be printed on the printing medium 100, the sub-pulses SUB2 may be applied to the dot 101 that immediately precedes the print dot 102 in the vertical scanning direction, in addition to the main pulses MP that are applied to the heating element 41A that may print the print dot 102, so the heating element 41A that may print the print dot 102 may not suffer an insufficiency of energy, and blurring of the print dot 102 may be prevented. Moreover, the sub-pulses SUB2 may not be appended within the print cycle that may print the print dot 102, the sub-pulses SUB1 may be applied at the same time T0 that the main pulses MP are applied, and the sub-pulses SUB1 include the basic pulse RP and a portion of the chopping pulses CP of main pulses MP, so the high-speed printing may be done without making the print cycle longer. Additionally, in the low-speed printing, the sub-pulses SUB1 may be applied to the heating element 41A that may print the print dot 102, so blurring of the print dot 102 may be prevented, even in the low-speed printing, which requires more printing energy.

Next, a second embodiment of the present invention will be explained. In the first embodiment explained above, the main printing control that is shown in FIG. 9 switches between the first printing control (the high-speed printing control) and the second printing control (the low-speed printing control) in accordance with the printing speed. In contrast to that, in the second embodiment, only the first printing control is performed across the entire speed range. Therefore, in the tape printer 1 according to the second embodiment, only the aforementioned processing in the flowchart that is shown in FIG. 10 is performed. The processing is the same as in the first printing control according to the first embodiment, so an explanation will be omitted.

In the tape printer 1 according to the second embodiment, in a case where the print dot 102 is printed on the printing medium 100, when the dot 112 that is adjacent to the print dot 102 in the main scanning direction is not to be printed on the printing medium 100, the sub-pulses SUB1 may be applied to the heating element 41A that is positioned opposite the dot 112 that is adjacent to the print dot 102 in the main scanning direction. Therefore, the heating element 41A that may print the print dot 102 may not suffer an insufficiency of energy, and blurring of the print dot 102 may be prevented. Furthermore, in a case where the dot 101 that immediately precedes the print dot 102 in the vertical scanning direction is not to be printed on the printing medium 100, the sub-pulses SUB2 may be applied to the heating element 41A that is positioned opposite the dot 101 that immediately precedes the print dot 102 in the vertical scanning direction, in addition to the main pulses MP that are applied to the heating element 41A that may print the print dot 102, so the heating element 41A that may print the print dot 102 may not suffer an insufficiency of energy, and blurring of the print dot 102 may be prevented.

Moreover, the sub-pulses SUB2 may be not appended within the print cycle for printing the print dot 102, the sub-pulses SUB1 may be applied at the same time T0 that the main pulses MP are applied, and the sub-pulses SUB1 include the basic pulse RP and a portion of the chopping pulses CP of main pulses MP, so the high-speed printing may be done without making the print cycle longer.

Various types of modifications may be made to the embodiments described above. For example, the embodiments described above explain using the tape printer 1 as an example of the printer, but the present invention may be applied to various types of thermal printers in which the thermal head 41 is mounted. In the case of a thermal printer for which the printing medium is a heat-sensitive paper, for example, the main heating may be an imparting of energy that can cause the heat-sensitive paper that is the printing medium to develop a color, and the auxiliary heating may be an imparting of energy that, by itself, cannot cause the heat-sensitive paper that is the printing medium to develop a color, but that can cause the heat-sensitive paper that is the printing medium to develop a color when combined with the main heating. In a case where the printer transfers ink from an ink ribbon to the printing medium, the main heating may be an imparting of energy that can transfer the ink from the ink ribbon, and the auxiliary heating may be an imparting of energy that, by itself, cannot transfer the ink from the ink ribbon, but that can transfer the ink from the ink ribbon to the printing medium when combined with the main heating.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

a thermal head that includes a line head in which heating elements are arranged in a straight line;

a feed device that is configured to feed a printing medium in a vertical scanning direction orthogonal to a main scanning direction, the main scanning direction being a direction in which the heating elements are arranged in the straight line in the line head; and a control device that is configured to control the feed device and the thermal head, the printer performing printing by forming a print dot by heating on the printing medium that is fed by the feed device in the vertical scanning direction of the thermal head, the printing medium being heated, in each iteration of a pulse application cycle that is sequentially repeated, by the control device's performing of pulse applying processing for selectively heating the heating elements that are arranged in the line head of the thermal head, wherein each iteration of the pulse application cycle is a time period from a main heating starting time to a next main heating starting time, the main heating starting time being a time at which applying of main pulses is started in the line head of the thermal head, in order to form on the printing medium a series of print dots in the vertical scanning direction of the thermal head, the main pulses being configured to implement main heating for forming the print dot on the printing medium, and the control device is configured to perform printing by using a first mode, in a case where the main heating by the main pulses is not performed on a second heating element that is adjacent in a main scanning direction to a first heating element, for which the main heating is performed by the main pulses, the first mode being a mode in which applying of the main pulses to the first heating element and applying of a first sub-pulse to the second heating element are both started at the same time starting from the main heating starting time, the first sub-pulse being configured to implement auxiliary heating that cannot form the print dot on the printing medium just by the applying of the first sub-pulse and that supplements the main heating of the first heating element by the main pulses.

2. The printer according to claim 1, wherein the control device is configured to perform printing by using the first mode and printing by using a second mode in which the auxiliary heating is performed on the first heating element by applying of a second sub-pulse to the first heating element, after the main pulses, within the pulse application cycle, the second sub-pulse being configured to implement auxiliary heating that cannot form the print dot on the printing medium just by the applying of the second sub-pulse and that supplements the main heating of the first heating element by the main pulses, and the control device is configured to perform printing using the second mode in a case where a low-speed printing mode is used, and is configured to perform printing using the first mode in a case where a high-speed printing mode is used, the high-speed printing mode being a mode in which a printing speed is faster than in the low-speed printing mode.

3. The printer according to claim 1, wherein the main pulses include a basic pulse and a chopping pulse, the basic pulse being applied for a specified time period, and the chopping pulse being applied for a specified number of iterations over a time span that is shorter than the specified time period for the basic pulse, and the first sub-pulse includes the basic pulse and a portion of the chopping pulse.

4. The printer according to claim 1, wherein the control device is configured to perform applying of a third sub-pulse to the first heating element, the third sub-pulse being configured to implement auxiliary heating that cannot form the print dot on the printing medium just by the applying of the third sub-pulse and that can form the print dot on the printing medium by supplementing the main heating by the main pulses that is to be applied in the next pulse application cycle, the applying of the third sub-pulse being performed in the current pulse application cycle in which the print dot is not to be formed on the printing medium only in a case where the next pulse application cycle is to be performed, the main pulses that are configured to implement the main heating for forming the print dot on the printing medium being to be applied, in the next pulse application cycle, immediately after the current pulse application cycle in which the print dot is not to be formed on the printing medium.

5. The printer according to claim 1, wherein the time period during which the first sub-pulse is applied to the second heating element is longer than a time period during which printing data for the line head are switched.

* * * * *